US010565959B2

(12) United States Patent
Park et al.

(10) Patent No.: US 10,565,959 B2
(45) Date of Patent: Feb. 18, 2020

(54) METHOD AND ELECTRONIC DEVICE FOR GENERATING NEW LUMINANCE LEVEL BETWEEN TWO ADJACENT LUMINANCE LEVELS

(71) Applicant: Samsung Electronics Co., Ltd., Gyeonggi-do (KR)

(72) Inventors: Kee Hyon Park, Gyeonggi-do (KR); Kyoung Min Park, Seoul (KR); Dae Keun Park, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 533 days.

(21) Appl. No.: 15/171,026

(22) Filed: Jun. 2, 2016

(65) Prior Publication Data

US 2016/0358583 A1 Dec. 8, 2016

(30) Foreign Application Priority Data

Jun. 3, 2015 (KR) ..... 10-2015-0078613

(51) Int. Cl.
*G09G 5/10* (2006.01)

(52) U.S. Cl.
CPC ..... *G09G 5/10* (2013.01); *G09G 2320/064* (2013.01)

(58) Field of Classification Search
CPC ..... H05B 33/0815; H05B 33/0803; H05B 33/0866; H05B 37/0281; H05B 33/0848; G09G 2320/0233; G09G 3/3233; G09G 2320/064; G09G 3/3406; G09G 2320/0646; G09G 3/2014; G09G 3/2018; G06F 1/1626
See application file for complete search history.

(56) References Cited

U.S. PATENT DOCUMENTS

2010/0012823 A1* 1/2010 Ahn ..... G06F 3/042 250/214 R
2013/0015770 A1* 1/2013 Aitken ..... G09G 3/3406 315/154
2014/0062328 A1* 3/2014 Toyooka ..... H05B 33/0866 315/210
2014/0125714 A1 5/2014 Pyo
2016/0119997 A1* 4/2016 Wen ..... H05B 33/0851 315/287

FOREIGN PATENT DOCUMENTS

KR 10-2014-0058283 A 5/2014

* cited by examiner

*Primary Examiner* — Gerald Johnson
(74) *Attorney, Agent, or Firm* — Cha & Reiter, LLC.

(57) ABSTRACT

A method comprising: obtaining at least one of a first current amount or a first pulse width that correspond to a first luminance level; obtaining at least one of a second current amount or a second pulse width that correspond a second luminance level; detecting at least one of a difference between the first current amount and the second current amount or a difference between the first pulse width and the second pulse width; and generating, by an electronic device, a new luminance level based on at least one of the difference between the first current amount and the second current amount or the difference between the first pulse width and the second pulse width, wherein the new luminance level is higher than the first luminance level and lower than the second luminance level.

32 Claims, 9 Drawing Sheets

METHOD AND ELECTRONIC DEVICE FOR GENERATING NEW LUMINANCE LEVEL BETWEEN TWO ADJACENT LUMINANCE LEVELS

CLAIM OF PRIORITY

This application claims the benefit under 35 U.S.C. § 119(a) of a Korean patent application filed on Jun. 3, 2015 in the Korean Intellectual Property Office and assigned Serial number 10-2015-0078613, the entire disclosure of which is hereby incorporated by reference.

TECHNICAL FIELD

The present disclosure relates to electronic devices, in general, and more particularly to a method and an electronic device for generating a new luminance level between two adjacent luminance levels.

BACKGROUND

Various types of electronic devices have recently provided various functions due to the trend of digital convergence. For example, the smartphones not only allow voice communications but also support an Internet connection function by using a network, a music or video reproducing function, and a function of photographing pictures or videos by using image sensors.

Although the details are different for respective manufacturers or products, the electronic devices display various contents by using a display panel (screen) of a suitable size to visually support the functions. Further, the electronic devices add options for adjusting the brightness, contrast, and luminance of the screen, for convenience of the users.

In addition, there have been needs for more various luminance levels that may be set in the conventional electronic devices. Meanwhile, when the user continuously increases or decreases luminance in the corresponding setting menu to set the luminance of the screen of the electronic device, the luminance on the screen of the electronic device is neither reflected continuously nor discretely.

SUMMARY

According to aspects of the disclosure, a method is provided comprising: obtaining at least one of a first current amount or a first pulse width that correspond to a first luminance level; obtaining at least one of a second current amount or a second pulse width that correspond a second luminance level; detecting at least one of a difference between the first current amount and the second current amount or a difference between the first pulse width and the second pulse width; and generating, by an electronic device, a new luminance level based on at least one of the difference between the first current amount and the second current amount or the difference between the first pulse width and the second pulse width, wherein the new luminance level is higher than the first luminance level and lower than the second luminance level.

According to aspects of the disclosure, an electronic device is provided comprising: a memory; and at least one processor operatively coupled to the memory, configured to: obtain at least one of a first current amount or a first pulse width that correspond to a first luminance level; obtain at least one of a second current amount or a second pulse width that correspond a second luminance level; detect at least one of a difference between the first current amount and the second current amount or a difference between the first pulse width and the second pulse width; and generate a new luminance level based on at least one of the difference between the first current amount and the second current amount or the difference between the first pulse width and the second pulse width, wherein the new luminance level is higher than the first luminance level and lower than the second luminance level.

According to aspects of the disclosure, an electronic device is provided comprising: a display module; a memory arranged to store an indication of at least one of a first current amount that corresponds to a first luminance level, a first pulse width that correspond to the first luminance level, a second current amount that corresponds a second luminance level, and a second pulse width that corresponds to the second luminance level; and at least one processor operatively coupled to the memory, configured to: identify a third luminance level based on at least one of the first current amount, the first pulse width, the second current amount, and the second pulse width, and operate the display module at the third luminance level, wherein a third current amount corresponding to the third luminance level is the same as the first current amount and lower than the second current amount, or a third pulse width corresponding to the third luminance level is greater than the first pulse width and the second pulse width.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
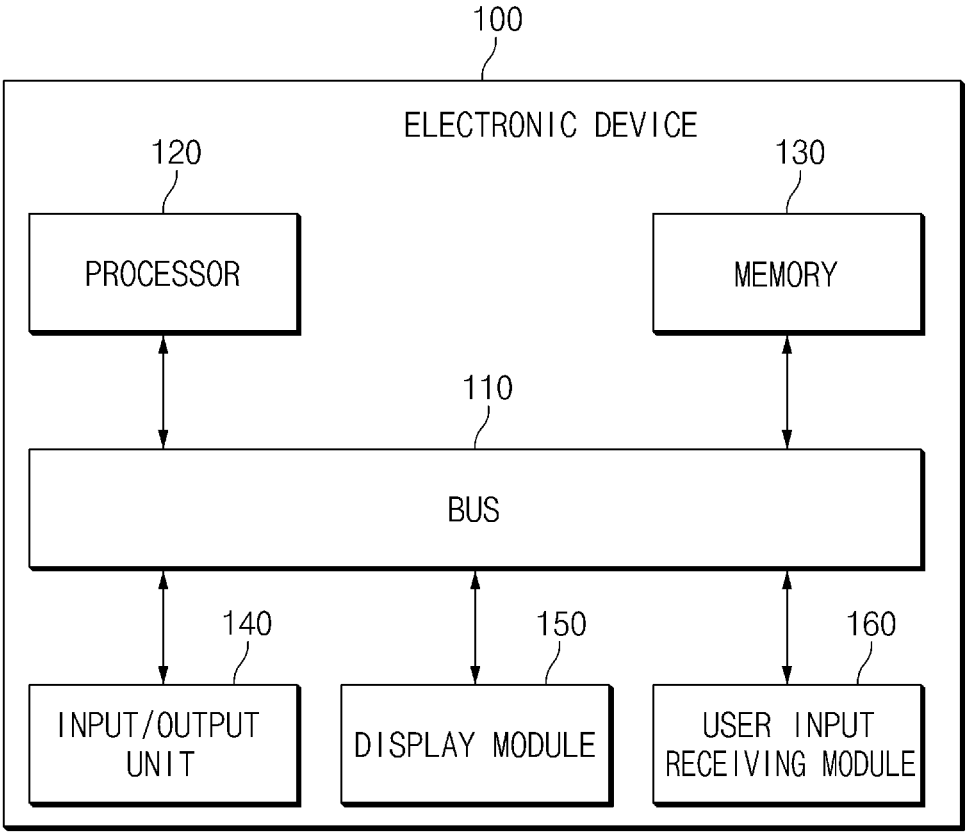
FIG. 1 is a block diagram of an example of an electronic device, according to various embodiments of the present disclosure.

Hereinafter, various embodiments of the present disclosure will be described with reference to the accompanying drawings. Accordingly, those of ordinary skill in the art will recognize that modification, equivalent, and/or alternative on the various embodiments described herein can be variously made without departing from the scope and spirit of the present disclosure. With regard to the description of drawings, similar components may be marked by similar reference numerals.

In the disclosure disclosed herein, the expressions "have", "may have", "include" and "comprise", or "may include" and "may comprise" used herein indicate existence of corresponding features (e.g., elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, such terms are used only to distinguish an element from another element and do not limit the order and/or priority of the elements. For example, a first user device and a second user device may represent different user devices irrespective of sequence or importance. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it can be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening elements (e.g., a third element).

According to the situation, the expression "configured to" used herein may be used as, for example, the expression "suitable for", "having the capacity to", "designed to", "adapted to", "made to", or "capable of". The term "configured to (or set to)" must not mean only "specifically designed to" in hardware. Instead, the expression "a device configured to" may mean that the device is "capable of" operating together with another device or other components. CPU, for example, a "processor configured to (or set to) perform A, B, and C" may mean a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in this specification are used to describe specified embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

The electronic device according to various embodiments of the present disclosure may include at least one, for example, of a smartphone, a tablet PC, a mobile phone, a mobile medical device, a camera, or a wearable device. In various embodiments of the present disclosure, the electronic device may be one or a combination of the aforementioned devices. The electronic device according to some embodiments of the present disclosure may be a flexible electronic device. Further, the electronic device according to an embodiment of the present disclosure is not limited to the aforementioned devices, but may include new electronic devices produced due to the development of technologies.

Hereinafter, electronic devices according to an embodiment of the present disclosure will be described with reference to the accompanying drawings. The term "user" used herein may refer to a person who uses an electronic device or may refer to a device (for example, an artificial electronic device) that uses an electronic device.

Hereinafter, it will be exemplified in the accompanying drawings that an electronic device according to various embodiments of the present disclosure is a smartphone.

FIG. 1 is a block diagram of an example of an electronic device 100, according to various embodiments of the present disclosure. The electronic device 100 may include a bus 110, a processor 120, a memory 130, an input/output unit 140, a display module 150, and a user input receiving module 160.

The configuration of the electronic device 100 illustrated in FIG. 1 is merely an implementation of the present disclosure, and may be variously modified. For example, although not illustrated in FIG. 1, the electronic device 100 may further include a communication module for exchanging communications with external devices. In this case, the electronic device 100 may use a wired/wireless network to perform the communication, and the network may include a cellular network and a data network.

The bus 110, for example, may include a circuit that connects the elements 110 to 160 and transfers communications (for example, control messages and/or data) between the elements.

The processor 120 may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc. The processor 120, for example, may control at least one other element of the electronic device 100. The processor 120 may load instructions or data received from at least one other element from the memory 130 to process the loaded instructions or data, and may store various data in the memory 130.

According to various embodiments of the present disclosure, the processor 120 may include at least one of a central processing unit (CPU), an application processor (AP), a touch screen panel integrated circuit (TSPIP), or a micro controller unit (MCU) (for example, a sensor hub MCU).

The memory 130 The controller 160 may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc. In operation, the memory 130 may store commands or data related to at least one other element of the electronic device 100. According to various embodiments, the memory 130 may store software and/or a program. The program, for example, may include a kernel, middleware, an application programming interface (API), and/or an application program (or "an application"). At least some of the kernel, the middleware, or the API may be referred to as an operating system (OS).

The input/output unit 140 may receive commands or data from the user or another external device, or may output commands or data received from the other element(s) of the electronic device 100 to the user or another external device.

According to various embodiments of the present disclosure, the input/output device 140, for example, is an input unit, and may include a touch panel, a keyboard, and a mouse. The touch panel, for example, may receive a touch input, for example, of a finger or a stylus pen. The touch input may include a hovering input as well as a physical contact input. The touch panel may recognize a touch input through at least one of a capacitive type, a resistive type, an infrared type, and an ultrasonic type. The touch panel may further include a control circuit. A capacitive touch panel may recognize a physical contact or a physical proximity to an input device (e.g., a stylus) or a user's finger. The touch panel further include a tactile layer.

The input/output unit 140, for example, may include a screen as an output unit. The screen 110, for example, may include a liquid crystal display (LCD), a light emitting diode (LED) display, an organic light emitting diode (OLED) display, a micro electromechanical system (MEMS) display, and an electronic paper display. The screen may have a flat shape, and may have a shape at least a portion of which is curved.

Although the input/output unit 140 may further include various units such as a speaker, a microphone, and a receiver in addition, a separate description thereof will be omitted.

The display module 150 may display various contents (for example, an application screen, a text, an image, a video, an icon, or a symbol) on the screen. The operation of displaying the various contents may be performed through a control of the processor 120.

The user input receiving module 160 may transfer commands or data to the processor 120 such that the processor 120 processes the commands or data input by the touch panel, the keyboard, or the mouse.

It will be sufficiently understood by those skilled in the art that the bus 110, the processor 120, the memory 130, the input/output device 140, the display module 150, and the user input receiving module 160 may be separately implemented in the electronic device 100 or one or more of them may be integrated.

Hereinafter, a method for inserting (or generating) a new luminance level by the processor 120 by using the one or more aforementioned elements will be described with reference to FIGS. 2 to 4.

Figure 2:
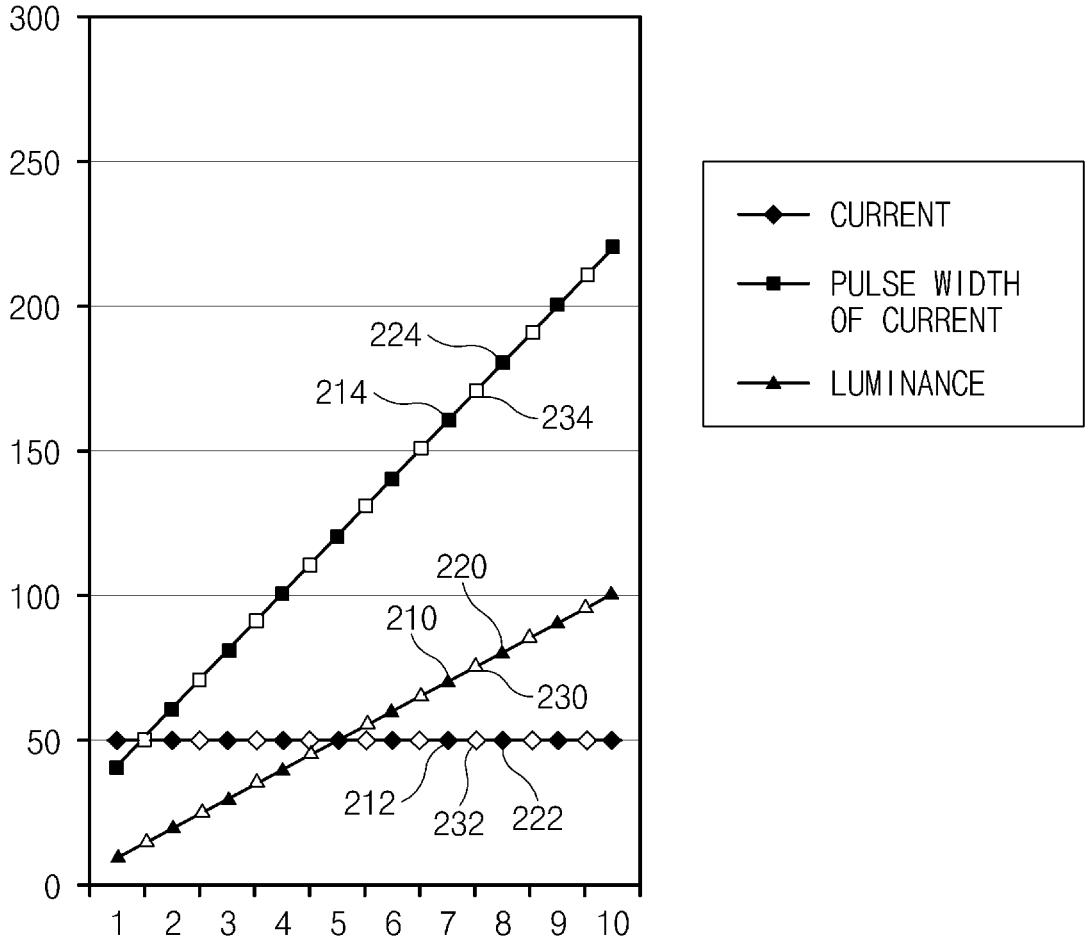
FIG.2 (PRIOR ART)
FIG. 2 is a graph representing new luminance levels that are generated when the pulse width of a signal increases while the amount of current of the signal remains fixed, according to the prior art.

FIG. 2 is a graph representing new luminance levels that are generated when the pulse width of a signal increases while the amount of current of the signal is fixed according to the prior art. In various embodiments of the present disclosure, the generating of a new luminance level may refer to an operation of expressing a luminance between adjacent existing luminance levels.

Referring to FIG. 2, the existing luminance level is indicated by ▲, the amount of current corresponding to the existing luminance level is indicated by ◆, and the pulse width of the currents corresponding to the existing luminance level is indicated by ■. Further, a newly added luminance level is indicated by Δ, the amount of current corresponding to the newly added luminance state is indicated by ◇, and the pulse width corresponding to the newly added luminance level is indicated by □.

The processor according to the prior art adjusts the luminance of a screen (for example, an OLED) displayed on the electronic device by adjusting the amount and the pulse width associated with current that flows through the screen. Referring to FIG. 2, the seventh luminance level 210 is determined based on the amount of current (hereinafter, the seventh amount of current) 212 and the pulse width of current (hereinafter, the seventh pulse width) 214 corresponding to the seventh luminance level 210. Similarly, the eighth luminance level 220 is determined based on the amount of current (hereinafter, the eighth amount of current) 222 and the pulse width of current (hereinafter, the eighth pulse width) 224 corresponding to the eighth luminance level 220.

Referring to the newly-generated luminance level 230, the processor according to the prior art maintains the amount of current corresponding to the seventh amount of current 212 (the amount of current 232), and generates a new luminance level 230 by increasing the pulse width of current as compared with the seventh pulse width of current 214. Thus, the pulse width of current 234 is larger than the seventh pulse width of current 214, but is smaller than the eighth pulse width of current 224. Further, the processor according to the prior art sets the amount of current 232 to be the same as the seventh amount of current 212 and the eighth amount of current 222.

As illustrated in FIG. 2, an operation of maintaining the amount of current, and generating a new luminance level by selecting an intermediate value between pulse widths of current of adjacent existing luminance levels by the processor according to the prior art is utilized in a low luminance range. Here, because the pulse widths of current have a period that is repeated within a determined frequency, they cannot have a pulse width of more than one period. Further, if the amount of current exceeds a threshold (e.g., if the amount of current becomes greater than or equal to a specific value), the life span of the screen may be shortened. Accordingly, a new method for subdividing the luminance levels within a range of the amounts of current or the pulse widths of current may be necessary in a high luminance range.

Hereinafter, a method for inserting (or generating) a new luminance level in a high luminance level will be described with reference to FIGS. 3A and 3B.

Figure 3A:
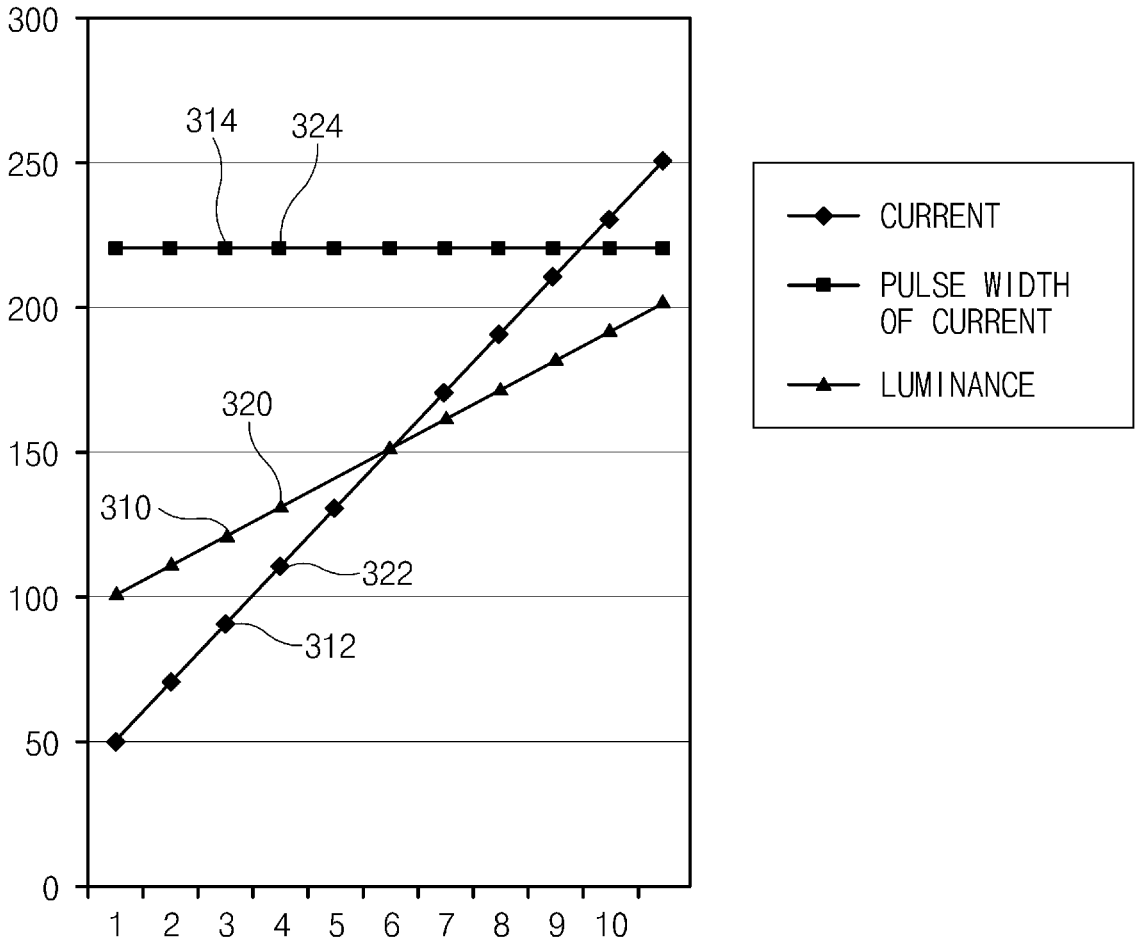
FIG. 3A is a graph illustrating an example of new luminance levels that are generated in a high luminance range, according to various embodiments of the present disclosure.
Figure 3B:
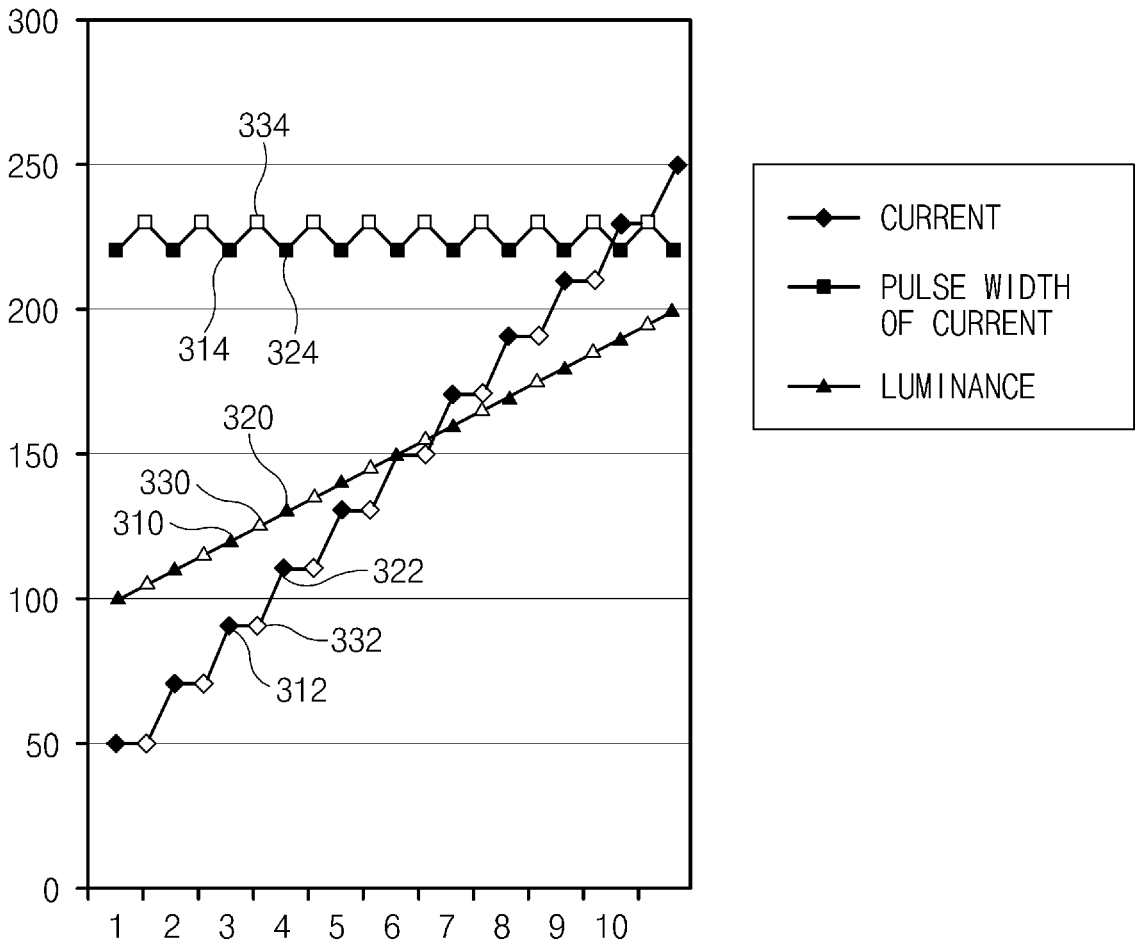
FIG. 3B is a graph illustrating an example of new luminance levels that are generated in a high luminance range, according to various embodiments of the present disclosure.

FIGS. 3A and 3B are graphs representing new luminance levels that are inserted (or generated) in a high luminance range, according to various embodiments of the present disclosure. FIG. 3A is a graph illustrating existing luminance levels, and the amounts of current and the pulse widths of signal(s) that determine different luminance levels. FIG. 3B is a graph illustrating examples of newly-generated luminance levels. Similarly to FIG. 2, in FIGS. 3A and 3B, the existing luminance level is indicated by ▲, the amount of current is indicated by ◆, and the pulse width of current is indicated by ■. Further, the newly added luminance level is indicated by Δ, the amount of current is indicated by ◇, and the pulse width of current is indicated by □.

Referring to FIG. 3A, the existing luminance levels shown in FIG. 3A are high luminance levels as compared with the existing luminance levels of FIG. 2, and the existing luminance levels of FIG. 3A are formed such that the amounts of current corresponding to the luminance levels increase while the pulse width associated with the current is fixed. Similarly to FIG. 2, the processor 120 may insert (or generate) a new luminance level by changing a changeable value (for example, the amount of current) while other values (for example, the pulse width of current) remain unchanged. For example, the processor 120 may insert (or generate) a new luminance level by setting the pulse width of current to be the same as a pulse width of current (hereinafter, a third pulse width of current) 314 corresponding to a third luminance level 310 and a pulse width of current (hereinafter, a fourth pulse width of current) 324 corresponding to a fourth luminance level 320, and setting the amount of current to be a value that is greater than an amount of current (hereinafter, a third amount of current) 312 corresponding to the third luminance level 310 and lower than an amount of current (hereinafter, a fourth amount of current) 322 corresponding to the fourth luminance level 320.

According to aspects of the disclosure, a method for inserting (or generating) a new luminance level by adjusting the pulse width of current while maintaining the amount of current will be described with reference to FIG. 3B. In FIG. 3B, a third luminance level 310 and a fourth luminance level 320 will be described. In some implementations, the processor 120 may adjust the pulse width of current by using pulse width modulation (PWM).

The processor 120 may provide a finer luminance for the user by generating new luminance levels between the luminance levels. Referring to the luminance level 330 that is newly-inserted between the third luminance level 310 and the fourth luminance level 320, the processor 120 may insert a new luminance level 330 by maintaining the amount of current (hereinafter, the third amount of current) 312 corresponding to the third luminance level 310 (the amount of current 332) and increasing the pulse width of current such that it is larger than the pulse width (hereinafter, the third pulse width of current) 314 corresponding to the third luminance level 310 (the pulse width of current 334).

As a preprocessing operation for inserting (or generating) the new luminance level, the processor 120 may identify a change in the amounts of current and a change in the pulse widths of current between adjacent existing luminance levels.

The method may be useful when it is difficult to change the amounts of current corresponding to the existing luminance levels. For example, the method may be useful when a difference between the amounts of current of the two adjacent luminance levels is equal to the minimum value by which the amount of current can be adjusted by the processor 120.

According to various embodiments of the present disclosure, the amounts of current and the pulse widths of current may be applied in an inverse way in FIG. 3.

Further, according to various embodiments of the present disclosure, both the amounts of current and the pulse widths of current corresponding to the existing luminance levels may increase. Further, not one luminance level, but two or more luminance levels may be inserted between the existing two luminance levels. FIG. 4 is a graph illustrating an example in which two new luminance levels are generated, according to various embodiments of the present disclosure. The processor 120 may insert two new luminance levels between a second luminance level 410 and a third luminance level 420.

The processor 120 may detect that an amount of current (hereinafter, a second amount of current) 412 corresponding to the second luminance level 410 and an amount of current (hereinafter, a third amount of current) 422 corresponding to the third luminance level 420 are the same and a pulse width of current (hereinafter, a second pulse width of current) 414 corresponding to the second luminance level 410 and a pulse width of current (hereinafter, a third pulse width of current) 424 corresponding to the third luminance level 420 increase. In such instances, the processor 120 may insert a new luminance level 430 that is associated with an amount of current (hereinafter, an amount of current 432) that is larger than the second amount of current 412 and a pulse width that is larger than the second pulse width of current 414. Further, the processor 120 may insert a new luminance level 442 at an amount of current (hereinafter, an amount of current 442) smaller than the third amount of current 422 and at a pulse width of current (hereinafter, a pulse width of current 440) smaller than the third pulse width of current 424.

According to various embodiments of the present disclosure, the processor 120 may display a luminance adjustment menu through the display module 150. The luminance adjustment menu may be displayed on a screen that is an input/output unit 140 of the electronic device 100, based on a user input received via the user input receiving module 160.

The processor 120 may select any one of the existing luminance levels and the luminance level newly inserted by the processor 120, based on the user input received through the user input receiving module 160 on the luminance adjustment menu. In this case, the luminance adjustment menu may provide a preview function for previewing a given luminance level that is selected from the menu. Moreover, the processor 120 may receive, via the user input receiving module 160, an input confirming the selection of the given luminance level. Afterwards, in response to the input, the processor 120 may begin operating the display module 150 at the given luminance level. More particularly, the processor 120 may provide a value that is optically corrected in response to the selected luminance level through the display module 150. As an example, the optical correction may include histogram matching and linear conversion. The histogram matching may include a correction that determines an image having an average value similar to the whole average value of an image included in a corrected area as a reference image and matching a histogram. The linear conversion may include a correction that determines a reference image by using an average image value that is to be corrected and applying a linear conversion coefficient by extracting a sample having a high correlation to obtain a statistical value.

According to various embodiments of the present disclosure, when the selected luminance level is an existing luminance level, the processor 120 may determine the selected luminance level as a luminance that is to be provided by the electronic device 100. If the selected luminance level is a newly inserted luminance level, the processor 120 may determine a value obtained by changing at least one of the amount of current or the pulse width of current corresponding to the selected luminance level by a specific value after selecting adjacent existing luminance levels, without determining the selected luminance level as a luminance that is to be provided by the electronic device 100.

For example, when the luminance level 230 is selected by the user in FIG. 2, the processor 120 may select the seventh luminance level 210 or the eighth luminance level 220 as a luminance that is to be provided by the electronic device 100. If the luminance of the luminance level 230 is closer to the luminance of the seventh luminance level 210 than to the luminance of the eighth luminance level 220, the processor 120 may determine a value obtained by changing at least one of the amount of current or the pulse width of current corresponding to the seventh luminance level 210 by a specific value as a luminance that is to be provided by the electronic device 100 after selecting the seventh luminance level 210.

Figure 4:
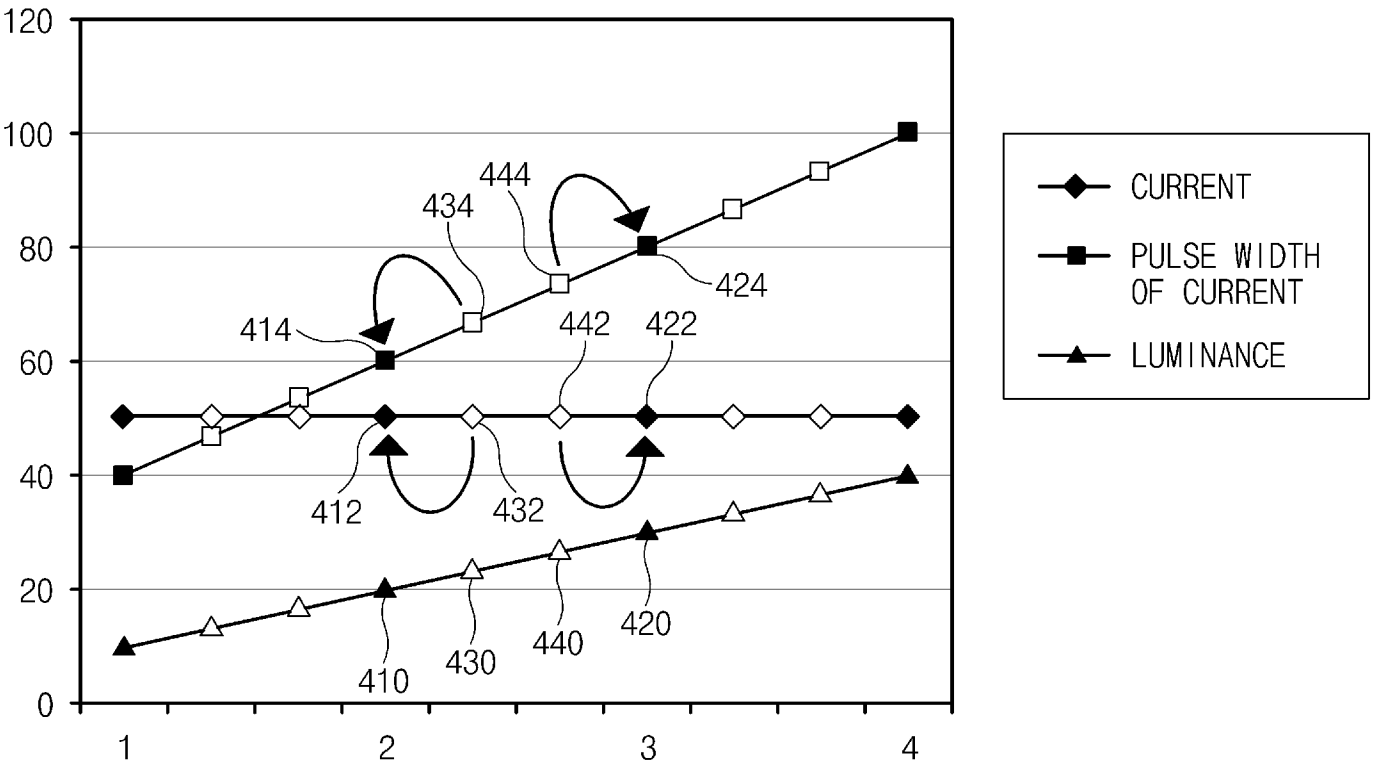
FIG. 4 is a graph illustrating an example in which two new luminance levels are generated, according to various embodiments of the present disclosure.

When the luminance level 430 is selected by the user in FIG. 4, the processor 120 may determine a value obtained by changing at least one of the amount of current or the pulse width corresponding to current of the second luminance level 410 by a specific value as a luminance that is to be provided by the electronic device 100. If the luminance level 440 is selected by the user, the processor 120 may determine a value obtained by changing at least one of the amount of current or the pulse width of current corresponding to the third luminance level 420 by a specific value as a luminance that is to be provided by the electronic device 100.

Also, the processor 120 may insert a new luminance level by changing the amount of current and the pulse width of current, but the newly inserted luminance levels may not suitable for being on the display unit 150. For example, when a combination of the amount of current and the pulse width of current is not suitable, the display unit 150 may exhibit signs of pixel deterioration when video is reproduced. Accordingly, even though a new luminance level 340 or 440 is selected, the processor 120 may set a limit such that the existing verified luminance level 410 or 420 is used. In other words, the processor 120 may differently provide new luminance levels according to the type of an application program that is being executed (and/or type of content that is being displayed). For example, when a new luminance level is set for content having various luminance changes (e.g., content having variable brightness), for example video, the processor 120 may apply the adjacent existing verified luminance levels. Further, when a new luminance level is set for content having few luminance changes (e.g., content having a non-variable brightness), for example a word document, the processor 120 may use a value obtained by changing the amount of current or the pulse width of current of the existing luminance level as a new luminance level.

Figure 5:
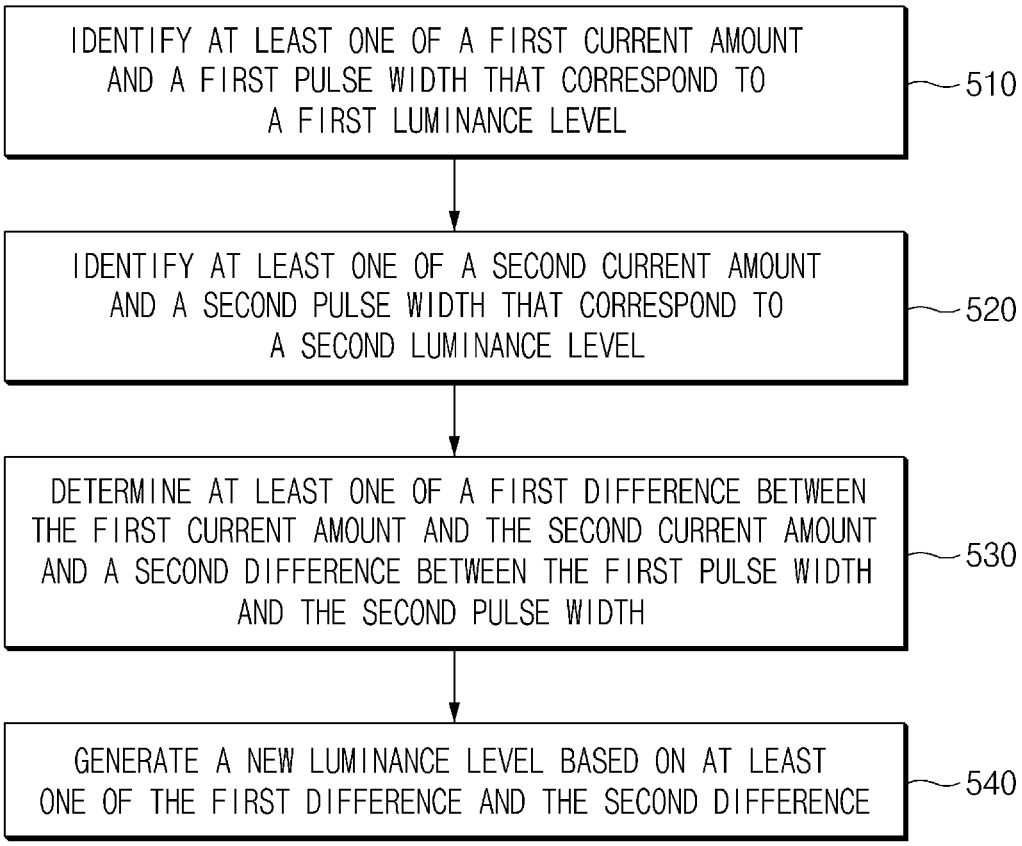
FIG. 5 is a flowchart of an example of a process, according to various embodiments of the present disclosure.

FIG. 5 is a flowchart of an example of a process, according to various embodiments of the present disclosure. The method of inserting (or generating) a new luminance level according to the embodiment illustrated in FIG. 5 may include operations performed in a time-series fashion by the electronic device according to the various embodiments illustrated in FIG. 4. Accordingly, even though omitted in the following, the contents described regarding the electronic device of FIGS. 1 to 4 may be applied to the method of inserting (or generating) a new luminance level according to the embodiment illustrated in FIG. 5.

In operation 510, the electronic device 100 may determine an amount of current (hereinafter, a first amount of current) and a pulse width of current (for example, a first pulse width of current) corresponding to a first luminance level.

In operation 520, similarly to operation 510, the electronic device 100 may determine an amount of current (hereinafter, a second amount of current) and a pulse width of current (for example, a second pulse width of current) corresponding to a second luminance level. In this case, the first luminance level and the second luminance level may existing continuous luminance levels.

In operation 530, the electronic device 100 may determine at least one of a first difference between the first current amount and the second current amount, and a second difference between the first pulse width and the second pulse width.

In operation 540, the electronic device 100 may insert (or generate) a new luminance level based on at least one of the first difference and the second difference. In some implementations, the new luminance level may be higher than the first luminance level and lower than the second luminance level.

Figure 6:
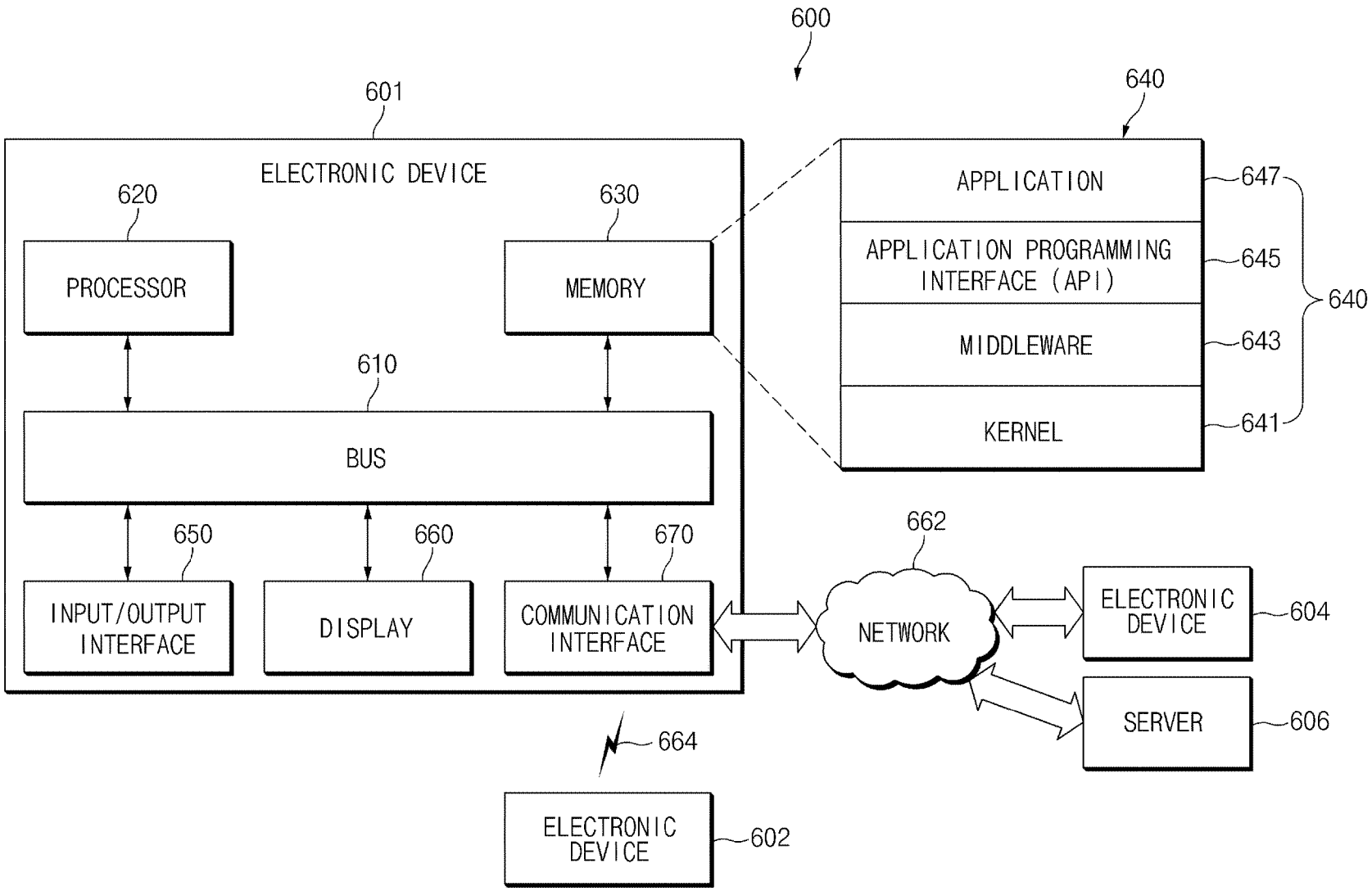
FIG. 6 is a diagram illustrating an example of an electronic device in a network environment, according to various embodiments of the present disclosure.

FIG. 6 is a diagram illustrating an example of an electronic device in a network environment, according to various embodiments of the present disclosure. Referring to FIG. 6, an electronic device 601 in a network environment 600 according to various embodiments will be described. The electronic device 601 may include a bus 610, a processor 620, a memory 630, an input/output interface 650, a display 660, and a communication interface 670. In some embodiments, the electronic device 601 may exclude at least one of the elements or may additionally include another element.

The bus 610, for example, may include a circuit that connects the elements 610 to 670 and transfers communications (for example, control messages and/or data) between the elements.

The processor 620 may include one or more of a central processing unit (CPU), an application processor (AP), or a communication processor (CP). The processor 620, for example, may execute operations or data processing related to the control and/or communication of at least one other element of the electronic device 601.

The memory 630 may include a volatile and/or nonvolatile memory. The memory 630, for example, may store commands or data related to at least one other element of the electronic device 601. According to an embodiment, the memory 630 may store software and/or a program 640. The program 640, for example, may include a kernel 641, middleware 643, an application programming interface (API) 645, and/or an application program (or an application) 647. At least some of the kernel 641, the middleware 643, or the API 645 may be referred to as an operating system (OS).

The kernel 641, for example, may control or manage system resources (for example, the bus 610, the processor 620, and the memory 630) that are used to execute operations or functions implemented in the other programs (for example, the middleware 643, the API 645, or the applications 647). The kernel 641 may provide an interface through which the middleware 643, the API 645, or the applications 647 access individual elements of the electronic device 601 to control or manage the system resources.

The middleware 643, for example, may function as an intermediary that allows the API 645 or the applications 647 to communicate with the kernel 641 to exchange data.

The middleware 643 may process one or more work requests received from the application programs 647, according to their priorities. For example, the middleware 643 may give a priority, by which a system resource (for example, the bus 610, the processor 620, or the memory 630) of the electronic device 601 may be used, to at least one of the application programs 647. For example, the middleware 643 may perform scheduling or load balancing for the one or more work requests by processing the one or more work requests according to the priority given to the at least one of the application programs 1047.

The API 645 is an interface used, by the application 647, to control a function provided by the kernel 641 or the middleware 643, and may include, for example, at least one interface or function (for example, an instruction), for example, for file control, window control, image processing, and text control.

The input/output interface 650, for example, may function as an interface that may transfer commands or data that are input from the user or another external device to another element(s) of the electronic device 601. The input/output interface 650 may output commands or data received from another element(s) of the electronic device to the user or anther external device 601.

The display 660, for example, may include a liquid crystal display (LCD), a light emitting diode (LED) display, an organic light emitting diode (OLED) display, a microelectromechanical system (MEMS) display, or an electronic paper display. The display 660, for example, may display various contents (for example, a text, an image, a video, an icon, and a symbol). The display 660 may include a touch screen and receive, for example, a touch, a gesture, a proximity, or a hovering input using an electronic pen or the user's body.

The communication interface 670, for example, may set communication between the electronic device 601 and an external device (for example, a first external electronic device 602, a second external electronic device 604, or a server 606). For example, the communication interface 670 may be connected to a network 662 through a wireless communication or a wired communication to communicate with the external device (for example, the second external electronic device 604 or the server 606).

The wireless communication is, for example, a cellular communication protocol, and, for example, may use at least one of long-term evolution (LTE), LTE-advanced (ATE-A), code division multiple access (CDMA), wideband CDMA (WCDMA), a universal mobile telecommunications system (UMTS), wireless broadband (WiBro), or a global system for mobile communications (GSM). Furthermore, the wireless communication, for example, may include a short range communication 664. The short range communication 664, for example, may include at least one of wireless fidelity (Wi-Fi), Bluetooth, a near field communication (NFC), or a global navigation satellite system (GNSS). The GNSS may include at least one of, for example, a global positioning system (GPS), a global navigation satellite system (Glonass), a Beidou navigation satellite system (hereinafter, "Beidou"), or the European global satellite-based navigation system (Galileo), according to an in-use area or a bandwidth. Hereinafter, in the present disclosure, the "GPS" may be interchangeably used with the "GNSS". The wired communication may include at least one of, for example, a universal serial bus (USB), a high definition multimedia interface (HDMI), recommended standard-232 (RS-232), and a plain old telephone Service (POTS). The network 662 may include at least one of communication networks, for example, a computer network (for example, a LAN or a WAN), the Internet, or a telephone network.

The first and second external electronic devices 602 and 604 may be the same or different type devices from the electronic device 601. According to an embodiment, the server 606 may include a group of one or more servers. According to various embodiments of the present disclosure, all or some of the operations executed by the electronic device 601 may be executed by another or a plurality of electronic devices (for example, the first external electronic device 602, the second external electronic device 604, or the server 606). According to an embodiment of the present disclosure, when the electronic device 601 should execute some functions or services automatically or upon request, it may request at least some functions associated with the functions or services from another electronic device (for example, the first external electronic device 601, the second external electronic device 602, or the server 606), in place of or in addition to directly executing the functions or services. The other electronic device (for example, the first external electronic device 601, the second external electronic device 602, or the server 606) may execute a requested function or an additional function, and may transfer the result to the electronic device 601. The electronic device 601 may process the received result directly or additionally, and may provide a requested function or service. To this end, for example, the cloud computing, distributed computing, or client-server computing technologies may be used.

Figure 7:
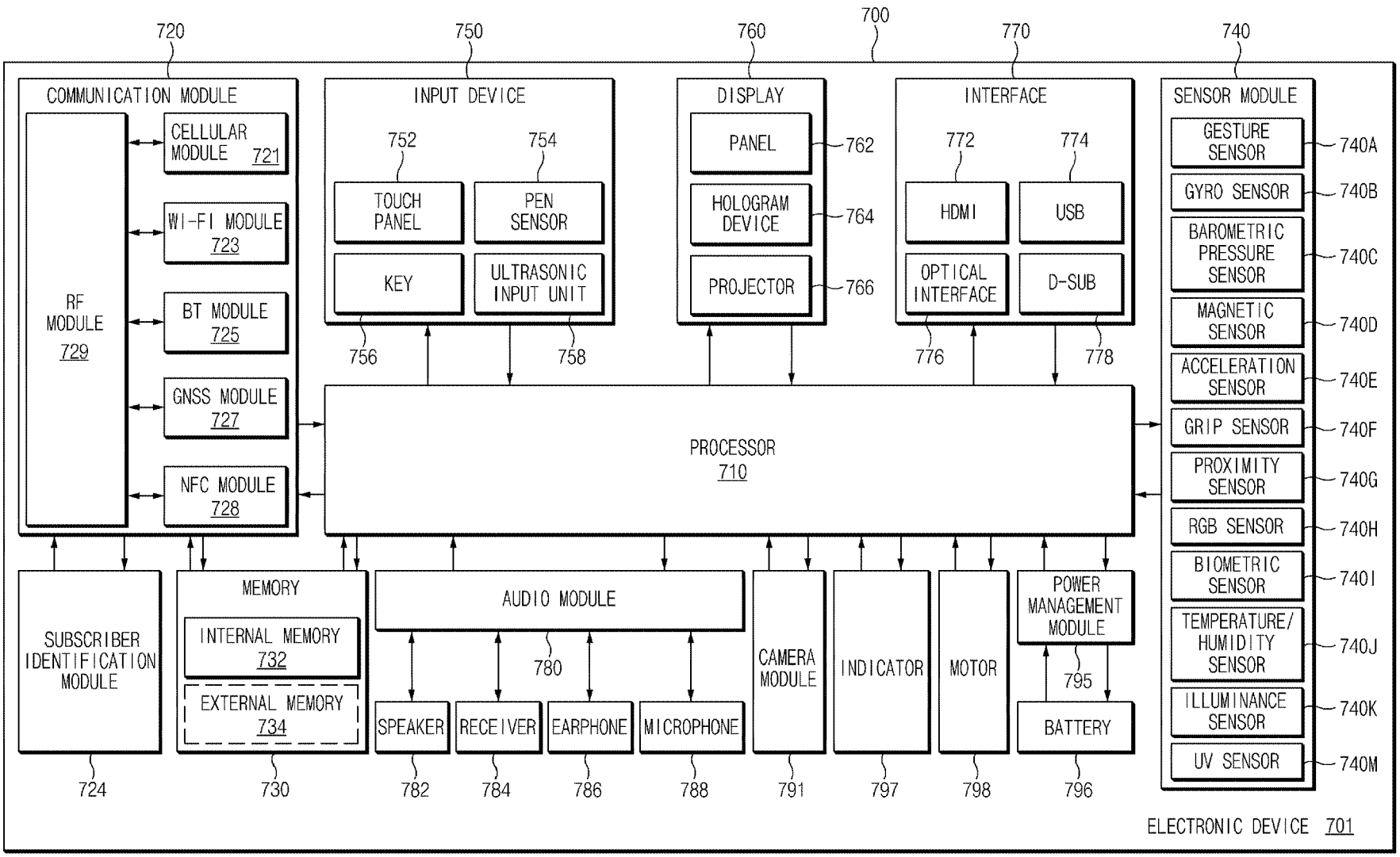
FIG. 7 is a block diagram of an example of an electronic device, according to various embodiments of the present disclosure.

FIG. 7 is a block diagram of an example of an electronic device 701, according to various embodiments. An electronic device 701 may include, for example, the entirety or a part of the electronic device 601 illustrated in FIG. 6. Referring to FIG. 701, the electronic device 31 may include at least one processor (for example, an application processor (AP) 710), a communication module 720, a subscriber identification module (SIM) card 724, a memory 730, a sensor module 740, an input device 750, a display 760, an interface 770, an audio module 780, a camera module 791, a power management module 795, a battery 796, an indicator 797, or a motor 798.

The processor 710 may control a plurality of hardware or software elements connected to the processor 710 by driving an operating system or an application program and perform a variety of data processing and calculations. The processor 710 may be implemented by, for example, a System on Chip (SoC). According to an embodiment, the processor 710 may further include a graphical processing unit (GPU) and/or an image signal processor. The processor 710 may include at least some (for example, a cellular module 721) of the elements illustrated in FIG. 7. The processor 710 may load instructions or data, received from at least one other element (for example, a non-volatile memory), in a volatile memory to process the loaded instructions or data, and may store various types of data in a non-volatile memory.

The communication module 720 may have the same or similar structure to the communication interface 670 of FIG. 6. The communication module 720 may include, for example, a cellular module 721, a Wi-Fi module 723, a Bluetooth module 725, a GNSS module 727 (for example, a GPS module, a Glonass module, a Beidou module, or a Galileo module), an NFC module 728, and a radio frequency (RF) module 729.

The cellular module 721 may provide a voice call, a video call, a text message service, or an Internet service through, for example, a communication network. According to an embodiment, the cellular module 721 may distinguish between and authenticate electronic devices 701 within a communication network using a subscriber identification module (for example, the SIM card 724). According to an embodiment, the cellular module 721 may perform at least some of the functions that the processor 710 may provide. According to an embodiment of the present disclosure, the cellular module 721 may include a communication processor (CP).

The Wi-Fi module 723, the BT module 725, the GPS module 727, and the NFC module 728 may include a processor for processing data transmitted/received through the corresponding module. According to some embodiments, at least some (two or more) of the cellular module 721, the Wi-Fi module 723, the Bluetooth module 725, the GNSS module 727, and the NFC module 728 may be included in one Integrated Chip (IC) or IC package.

The RF module 729 may transmit/receive, for example, a communication signal (for example, an RF signal). The RF module 729 may include, for example, a transceiver, a Power Amp Module (PAM), a frequency filter, a Low Noise Amplifier (LNA), or an antenna. According to another embodiment, at least one of the cellular module 721, the Wi-Fi module 723, the Bluetooth module 725, the GNSS module 727, or the NFC module 728 may transmit and receive an RF signal through a separate RF module.

The subscriber identification module 724 may include, for example, a card including a subscriber identification module and/or an embedded SIM, and may further include unique identification information (for example, an integrated circuit card identifier (ICCID)) or subscriber information (for example, international mobile subscriber identity (IMSI)).

The memory 730 (for example, the memory 630) may include, for example, an internal memory 732 or an external memory 734. The internal memory 732 may include at least one of, for example, a volatile memory (for example, a dynamic random-access memory (DRAM), a static RAM (SRAM), a synchronous dynamic RAM (SDRAM), and the like) and a non-volatile memory (for example, a one-time programmable read-only Memory (OTPROM), a programmable ROM (PROM), an erasable and programmable ROM (EPROM), an electrically erasable and programmable ROM (EEPROM), a flash memory (for example, a NAND flash memory or a NOR flash memory), a hard driver, or a solid state drive (SSD).

The external memory 734 may further include a flash drive, for example, a Compact Flash (CF), a Secure Digital (SD), a Micro Secure Digital (Micro-SD), a Mini Secure Digital (Mini-SD), an eXtreme Digital (xD), or a memory stick. The external memory 734 may be functionally and/or physically connected to the electronic device 701 through various interfaces.

The sensor module 740 may measure, for example, a physical quantity or detect an operation state of the electronic device 701, and may convert the measured or detected information to an electrical signal. The sensor module 740 may include at least one of, for example, a gesture sensor 740A, a gyro sensor 740B, an atmospheric pressure sensor 740C, a magnetic sensor 740D, an acceleration sensor 740E, a grip sensor 740F, a proximity sensor 740G, a color sensor 740H (for example, red, green, and blue (RGB) sensor), a biometric sensor 740I, a temperature/humidity sensor 740J, an illumination sensor 740K, and a Ultra Violet (UV) sensor 740M. Additionally or alternatively, the sensor module 740 may include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 740 may further include a control circuit for controlling one or more sensors included therein. In some embodiments, the electronic device 701 may further include a processor configured to control the sensor module 740 as a part of or separately from the processor 710, and may control the sensor module 740 while the processor 710 is in a sleep state.

The input device 750 may include, for example, a touch panel 752, a (digital) pen sensor 754, a key 756, or an ultrasonic input device 758. The touch panel 752 may use at least one of, for example, a capacitive type, a resistive type, an infrared type, and an ultrasonic type. The touch panel 752 may further include a control circuit. The touch panel 752 may further include a tactile layer, and provide a tactile reaction to a user.

The (digital) pen sensor 754 may include, for example, a recognition sheet which is a part of the touch panel or a separate recognition sheet. The key 756 may include, for example, a physical button, an optical key, or a keypad. The ultrasonic input device 758 may detect ultrasonic waves generated by an input tool through a microphone (for example, a microphone 788) and may identify data corresponding to the detected ultrasonic waves.

The display 760 (for example, the display 660) may include a panel 762, a hologram device 764, or a projector 766. The panel 762 may include an element equal or similar to the display 660 of FIG. 6. The panel 762 may be implemented to be, for example, flexible, transparent, or wearable. The panel 762 may be formed as a single module together with the touch panel 752. The hologram device 764 may show a three dimensional image in the air using an interference of light. The projector 766 may display an image by projecting light onto a screen. The screen may be located, for example, in the interior of or on the exterior of the electronic device 701. According to an embodiment, the display 760 may further include a control circuit for controlling the panel 762, the hologram device 764, or the projector 766.

The interface 770 may include, for example, a high-definition multimedia interface (HDMI) 772, a universal serial bus (USB) 774, an optical interface 776, or a D-sub-miniature (D-sub) 778. The interface 770 may be included in, for example, the communication interface 670 illustrated in FIG. 6. Additionally or alternatively, the interface 770 may include, for example, a Mobile High-definition Link (MHL) interface, a Secure Digital (SD) card/Multi-Media Card (MMC) interface, or an Infrared Data Association (IrDA) standard interface.

The audio module 780 may bilaterally convert, for example, a sound and an electrical signal. At least some elements of the audio module 780 may be included in, for example, the input/output interface 650 illustrated in FIG. 6. The audio codec 780 may process voice information input or output through, for example, a speaker 782, a receiver 784, earphones 786, or the microphone 788.

The camera module 791 is a device which may photograph a still image and a dynamic image. According to an embodiment, the camera module 291 may include one or more image sensors (for example, a front sensor or a back sensor), a lens, an Image Signal Processor (ISP) or a flash (for example, an LED or xenon lamp).

The power management module 795 may manage, for example, power of the electronic device 701. According to an embodiment of the present disclosure, the power management module 795 may include a Power Management Integrated Circuit (PMIC), a charger Integrated Circuit (IC), or a battery or fuel gauge. The PMIC may have a wired and/or wireless charging scheme. Examples of the wireless charging method may include, for example, a magnetic resonance method, a magnetic induction method, an electromagnetic wave method, and the like. Additional circuits (for example, a coil loop, a resonance circuit, a rectifier, etc.) for wireless charging may be further included. The battery gauge may measure, for example, a residual quantity of the battery 796, and a voltage, a current, or a temperature while charging. The battery 796 may include, for example, a rechargeable battery and/or a solar battery.

The indicator 797 may indicate particular status of the electronic device 701 or a part thereof (for example, the processor 710), for example, a booting status, a message status, a charging status, or the like. The motor 798 may convert an electrical signal into mechanical vibrations, and may generate a vibration or haptic effect. Although not illustrated, the electronic device 701 may include a processing device (for example, a GPU) for supporting mobile TV. The processing unit for supporting mobile TV may process, for example, media data pursuant to a certain standard of Digital Multimedia Broadcasting (DMB), Digital Video Broadcasting (DVB), or media flow (MediaFlo™).

Each of the elements described in the specification may include one or more components, and the terms of the elements may be changed according to the type of the electronic device. In various embodiments of the present disclosure, the electronic device may include at least one of the elements described in the specification, and some elements may be omitted or additional elements may be further included. Some of the elements of the electronic device according to various embodiments may be coupled to form one entity, and may perform the same functions of the corresponding elements before they are coupled.

Figure 8:
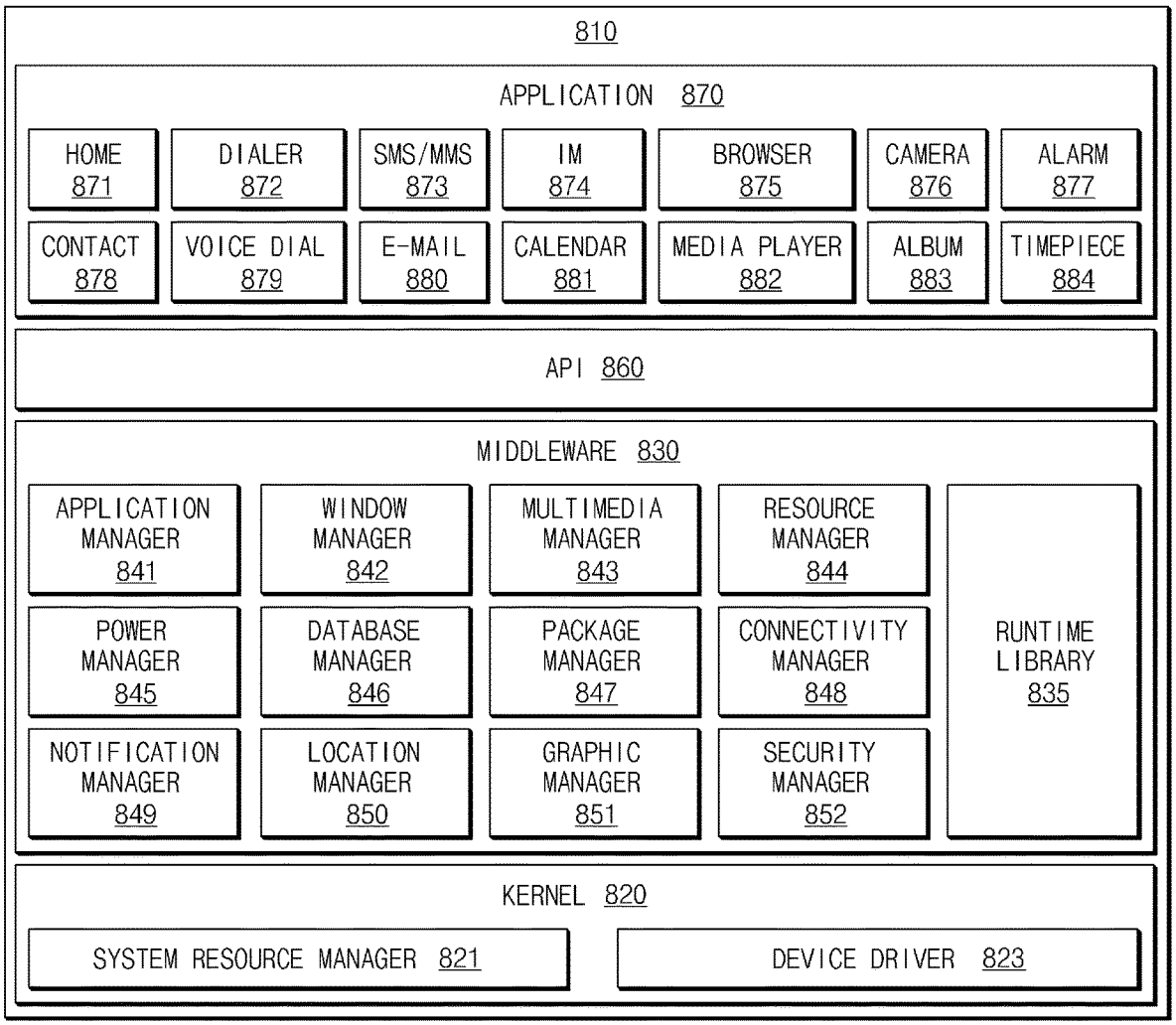
FIG. 8 is a block diagram of an example of a program module, according to various embodiments of the present disclosure.

FIG. 8 is a block diagram of an example of a program module, according to various embodiments. According to an embodiment, the program module 810 (for example, a program 640) may include an operating system (OS) that controls resources related to an electronic device, and various application programs (for example, an application program 647) that is driven on an operating system. The operating system may be, for example, Android, iOS, Windows, Symbian, Tizen, Bada, or the like.

The program module 810 may include a kernel 820, a middleware 830, an application programming interface (API) 860, and/or applications 870. At least a part of the program module 810 may be preloaded on an electronic device or may be downloaded from external electronic devices (for example, first and second external electronic devices 604 and 606 and a server 606).

The kernel 820 (for example, the kernel 641) may include, for example, a system resource manager 821 and/or a device driver 823. The system resource manager 821 may control, allocate, or retrieve the system resources. According to one embodiment, the system resource manager 821 may include a process management unit, a memory management unit, or a file system management unit. The device driver 823 may include, for example, a display driver, a camera driver, a Bluetooth driver, a shared-memory driver, a USB driver, a keypad driver, a Wi-Fi driver, an audio driver, or an Inter-Process Communication (IPC) driver.

The middleware 830 may provide a function required by the applications 870 in common or provide various functions to the applications 870 through the API 860 so that the applications 870 can efficiently use limited system resources of the electronic device. According to an exemplary embodiment, the middleware 830 (for example, the middleware 643) may include, for example, at least one of a runtime library 835, an application manager 841, a window manager 842, a multimedia manager 843, a resource manager 844, a power manager 845, a database manager 846, a package manager 847, a connectivity manager 848, a notification manager 849, a location manager 850, a graphic manager 851, and a security manager 852.

The run time library 835 may include, for example, a library module that a compiler uses in order to add new functions through a programming language while the applications 870 are executed. The run time library 835 may perform input/output management, memory management, or a function for an arithmetic function.

The application manager 841, for example, may manage a lifecycle of at least one of the applications 870. The window manager 842 may manage a GUI resource used on a screen. The multimedia manager 843 may detect a format required for reproducing various media files and encode or decode a media file using a codec appropriate for the corresponding format. The resource manager 844 may manage resources, such as a source code, a memory, or a storage space, of at least one of the applications 870.

The power manager 845 may operate together with, for example, a basic input/output System (BIOS), so as to manage a battery or power and may provide power information required for the operation of the electronic device. The database manager 846 may generate, search for, or change a database to be used by at least one of the applications 870. The package manager 847 may manage the installation or the updating of applications distributed in a package file form.

For example, the connectivity manager 848 may manage wireless connections, such as Wi-Fi or Bluetooth. The notification manager 849 may display or notify an event such as a received message, an appointment, a proximity notification, and the like to a user without disturbance. The location manager 850 may manage location information of the electronic device. The graphic manager 851 may manage graphic effects to be provided to a user and user interfaces related to the graphic effects. The security manager 852 may provide various security functions required for system security or user authentication. According to an embodiment of the present disclosure, when the electronic device (for example, the electronic device 601) has a phone function, the middleware 830 may further include a telephony manager for managing a voice or video communication function of the electronic device.

The middleware 830 may include a middleware module for forming a combination of various functions of the aforementioned elements. The middleware 830 may provide modules specialized according to the type of OS in order to provide differentiated functions. In addition, some existing elements may be dynamically removed from the middleware 830, or new elements may be added to the middleware 230.

The API 860 (for example, the API 645) is, for example, a set of API programming functions, and may be provided another configuration according to an operating system. For example, for each platform, one API set may be provided in a case of Android or iOS, and two or more API sets may be provided in a case of Tizen.

The application 870 (for example, the application program 647) may include, for example, a home 871, a dialer 872, an SMS/MMS 873, an instant message (IM) 874, a browser 875, a camera 876, an alarm 877, a contact 878, a sound dial 879, an e-mail 880, a calendar 881, a media player 882, an album 883, a clock 884, or at least one application that may provide health care (for example, measuring an exercise degree or blood glycose) or environmental information.

According to an embodiment, the application 870 may include an application (hereinafter, referred to as "an information exchange application for convenience of description) that supports exchange of information between the electronic device (for example, the electronic device 601) and other electronic devices (for example, the first external electronic device 602 and the second external electronic device 604). The information exchange application may include, for example, a notification relay application for forwarding specific information to an external electronic device, or a device management application for managing an external electronic device.

For example, the notification relay application may have a function of forwarding, to other electronic devices (for example, the first electronic device 602 and the second electronic device 604), notification information generated from other applications of the electronic device 10 (for example, an SMS/MMS application, an e-mail application, a health care application, and an environmental information application). The notification relay application may receive notification information from, for example, an external electronic device and provide the received notification information to a user.

The device management application may, for example, manage (for example, install, delete, or update) a function for at least a part of an external electronic device (for example, the first electronic device 602 and the second electronic device 604) communicating with the electronic device 10 (for example, activating/deactivating the external electronic device itself (or some components thereof) or adjusting the brightness (or resolution) of a display), an application operating in the external electronic device, or a service provided from the external electronic device (for example, a telephone call service or a message service).

According to an embodiment, the application 870 may include an application (for example, a health management application) designated according to an attribute of another device (for example, the first electronic device 602 and the second electronic device 604). According to an embodiment, the application 870 may include an application that is received from an external electronic device (for example, the first electronic device 602, the second electronic device 604, or the server 606). According to an embodiment of the present disclosure, the applications 870 may include a preloaded application or a third party application that is downloaded from a server. The names of the elements of the program module 810 according to the illustrated embodiment may vary according to the type of the operating system.

According to various embodiments, at least a part of the program module 810 may be implemented by software, firmware, hardware, or two or more combinations thereof. At least a part of the program module 810, for example, may be implemented (for example, executed) by a processor (for example, the processor 710). At least a part of the program module 810 may include, for example, a module, a program routine, a set of instructions, or a process for performing at least one function.

An electronic device according to various embodiments of the present disclosure may include a memory that stores amounts of current and pulse widths of current for a first luminance level, a second luminance level and a processor electrically connected to the memory. In this case, the processor may when the processor does not expressed an object on a display based on the first luminance level and second luminance level, wherein the processor is configured to generate the third luminance level and apply to the electronic device, wherein the amount of current for the third luminance level is the same as the amount of current for the first luminance level and lower than the amount of current for the second luminance level, or the pulse width of current for the third luminance level is higher than the pulse width of current for the first luminance level and the pulse width of current for the second luminance level.

A method for generating a new luminance level according to various embodiments of the present disclosure may include determining at least one of a first amount of current or a first pulse width of current for a first luminance level, determining at least one of a second amount of current or a second pulse width of current for a second luminance level that is adjacent to the first luminance level, determining at least one of a current amount increment relationship between the first amount of current and the second amount of current or a current pulse width increment relationship between the first current pulse width and the second current pulse width, and generating at least one new luminance level between the first luminance level and the second luminance level, based on at least one of the current amount increment relationship or the current pulse width increment width.

According to various embodiments of the present disclosure, the generating of the new luminance level may be performed by using a value obtained by changing at least one of the first amount of current or the first pulse width of current.

According to various embodiments of the present disclosure, when there is no increment relationship between the first amount of current and the second amount of current and there is an increment relationship between the first pulse width of current and the second pulse width of current, the generating of the at least one luminance level may be performed by changing the first pulse width of current.

According to various embodiments of the present disclosure, a value obtained by changing the first pulse width of current may be a value between the first pulse width of current and the second pulse width of current.

According to various embodiments of the present disclosure, when there is an increment relationship between the first amount of current and the second amount of current and there is no increment relationship between the first pulse width of current and the second pulse width of current, the generating of the at least one luminance level may be performed by changing the first pulse width of current.

According to various embodiments of the present disclosure, a value obtained by changing the first pulse width of current may be a value that is larger than the first pulse width of current.

According to various embodiments of the present disclosure, the method may further include displaying a luminance adjustment menu, from which any one of the first luminance level, the second luminance level, and the newly generated luminance level is selectable, on a screen by an electronic device, and applying a function of previewing the luminance level selected from the luminance adjustment menu, to the screen of the electronic device.

According to various embodiments of the present disclosure, the method may further include receiving a user input that applies the selected luminance level as a luminance of the screen of the electronic device, and applying the first luminance level or the second luminance level as the luminance of the screen of the electronic device, based on the user input.

According to various embodiments of the present disclosure, the applying of the first luminance level or the second luminance level may include, when the selected luminance level is the newly generated luminance level, determining a value obtained by changing at least one of the amount of current or the pulse width of current of the first luminance level or the second luminance level, which is preset in response to the newly generated luminance level as a luminance level that is to be applied to the screen of the electronic device.

According to various embodiments of the present disclosure, when two new luminance levels are generated, the applying of the first luminance level or the second luminance level may include determining a value obtained by changing at least one of the amounts of current or the pulse widths of current of the first luminance level or the second luminance level, which is close to a luminance of the luminance level selected from the first luminance level or the second luminance level, as a luminance level that is to be applied to the screen of the electronic device.

According to various embodiments of the present disclosure, a difference between the first amount of current and the second amount of current is a minimum unit of the adjustable amount of current.

An electronic device according to various embodiments of the present disclosure may include a display module, and a processor electrically connected to the display module. In this case, the processor may determine at least one of a first amount of current or a first pulse width of current for a first luminance level, determines at least one of a second amount of current or a second pulse width of current for a second luminance level that is adjacent to the first luminance level, and may insert (or generate) at least one new luminance level between the first luminance level and the second luminance level, based on at least one of a current amount increment relationship between the first amount of current and the second amount of current or a current pulse width increment relationship between the first pulse width of current and the second pulse width of current.

According to various embodiments of the present disclosure, the electronic device may further include a user input receiving module electrically connected to the processor. In this case, the processor may receive a user input that invokes a luminance adjustment menu, through the user input receiving module, and may display the luminance adjustment menu including the first luminance level, the second luminance level, and the newly generated luminance level on a screen, through the display module.

According to various embodiments of the present disclosure, the processor may receive a user input that selects any one of the first luminance level, the second luminance level, and the newly generated luminance level from the luminance adjustment menu, through the user input receiving module, and may reflect the selected luminance level in a preview mode on the screen of the electronic device through the display module.

According to various embodiments of the present disclosure, the processor may receive a user input that determines the selected luminance level as a luminance, which is to be provided by the electronic device, through the user input receiving module, and may determine the first luminance level or the second luminance level as the luminance, which is to be provided by the electronic device, according to settings. Further, when the user input is a selection of a new luminance level, the processor may apply a value obtained by changing at least one of the amount of current or the pulse width of current of an existing luminance level that are relatively adjacent to the selected new luminance level as a new luminance level. Further, even though a new luminance level is selected, the processor may apply an adjacent existing luminance level without applying a new luminance level, according to the type of the executed program. For example, when an optical correction of a specific size or more is necessary to apply a new luminance level, the processor may apply a relatively adjacent existing luminance level. During histogram matching, the degree of optical correction may be a matching rate. Further, the degree of optical correction may be the size of a statistical value that is linearly converted. When the matching rate or the statistical value of a specific size is exceeded, the processor may select an existing luminance level to apply a luminance.

The term "circuit" used in the specification may mean a unit including, for example, one of hardware, software, or firmware or a combination of the two or more of them. The circuit may be interchangeably used, for example, with a unit, a logic, a logical block, a component, or a module. The circuit may be a minimum unit or a part of an integrally configured part. The circuit may be a minimum unit or a part which performs one or more functions. The circuit may be implemented mechanically or electromagnetically. For example, the circuit may include at least one of an application-specific integrated circuit (ASIC) chip, a field-programmable gate array, or a programmable-logic device, which has been known, will be developed in the future, or performs certain operations.

At least some of the devices (for example, modules or functions) or methods (for example, operations) according to various embodiments of the present disclosure may be implemented by an instruction stored in a computer-readable storage medium, for example, in the form of a program module. When the instruction is executed by the processor (for example, the processor 620), the at least one processor may perform a function corresponding to the instruction. The computer-readable storage medium may be, for example, a memory 630.

According to various embodiments of the present disclosure, there may be provided a computer-readable medium in which an instruction that is executed by at least one processor and can be read by a computer, wherein the instruction may be set to perform an operation of determining at least one of a first amount of current or a first pulse width of current for a first luminance level, an operation of determining at least one of a second amount of current or a second pulse width of current for a second luminance level that is adjacent to the first luminance level, an operation of determining at least one of a current amount increment relationship between the first amount of current and the second amount of current or a current pulse width increment relationship between the first current pulse width and the second current pulse width; and an operation of generating at least one new luminance level between the first luminance level and the second luminance level, based on at least one of the current amount increment relationship or the current pulse width increment width.

The computer-readably storage medium may include a hard disk, a floppy disk, a magnetic medium (for example, a magnetic tape), an optical medium (for example, a compact disk read-only memory (CD-ROM)), a digital versatile disk (DVD), a magneto-optical medium (for example, a floptical disk), a hardware device (for example, a read-only memory (ROM), a random access memory (RAM), or a flash memory). Further, the program instructions may include high-level language codes which may be executed by a computer using an interpreter as well as machine languages created by using a compiler. The above-mentioned hardware device may be configured to be operated as one or more software module to perform operations of various embodiments, and the converse is true.

The module or program module according to various embodiments of the present disclosure may include at least one of the above-mentioned element, omit some of them, or further include other elements. The module, the program module, or the operations performed by other elements according to various embodiments of the present disclosure may be performed in a sequential, parallel, iterative, or heuristic method. Further, some operations may be executed in another sequence or may be omitted, or other operations may be added.

According to various embodiments of the present disclosure, more various luminance levels can be provided for the user and conventional luminance levels can be set in an aspect of stability when a new luminance level is requested.

The above-described aspects of the present disclosure can be implemented in hardware, firmware or via the execution of software or computer code that can be stored in a recording medium such as a CD-ROM, a Digital Versatile Disc (DVD), a magnetic tape, a RAM, a floppy disk, a hard disk, or a magneto-optical disk or computer code downloaded over a network originally stored on a remote recording medium or a non-transitory machine-readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for". The terms "unit" or "module" referred to herein is to be understood as comprising hardware such as a processor or microprocessor configured for a certain desired functionality, or a non-transitory medium comprising machine executable code, in accordance with statutory subject matter under 35 U.S.C. § 101 and does not constitute software per se.

Moreover, the embodiments disclosed in this specification are suggested for the description and understanding of technical content but do not limit the range of the present disclosure. Accordingly, the range of the present disclosure should be interpreted as including all modifications or various other embodiments based on the technical idea of the present disclosure.

What is claimed is:

1. A method comprising:

obtaining, by an electronic device, information of at least one of a first current amount and a first pulse width that correspond to a first luminance level, and information of at least one of a second current amount and a second pulse width that correspond a second luminance level;

detecting, by the electronic device, a difference between the first current amount and the second current amount and a difference between the first pulse width and the second pulse width; and generating, by the electronic device, a new luminance level based on at least one of the difference between the first current amount and the second current amount or the difference between the first pulse width and the second pulse width, wherein when there is difference between the first current amount and the second current amount and there is no difference between the first pulse width and the second pulse width, the new luminance level is generated by changing the first pulse width.

2. The method of claim 1, wherein the new luminance level is generated by changing at least one of the first current amount or the first pulse width.

3. The method of claim 1, wherein when there is no difference between the first current amount and the second current amount and there is a difference between the first pulse width and the second pulse width, the new luminance level is generated by changing the first pulse width to a new pulse width.

4. The method of claim 3, wherein the new pulse width is greater than the first pulse width and smaller than the second pulse width.

5. The method of claim 1, wherein changing the first pulse width includes increasing the first pulse width.

6. The method of claim 1, further comprising:

displaying, on a screen of the electronic device, a luminance adjustment menu, wherein any of the first luminance level, and the new luminance level is selectable from the luminance adjustment menu; and previewing a given luminance level that is selected from the luminance adjustment menu on the screen of the electronic device.

7. The method of claim 6, further comprising:

detecting an input that applies the given luminance level as a luminance of the screen of the electronic device; and changing the luminance level of the screen of the electronic device to the given luminance level in response to the input.

8. The method of claim 7, wherein the given luminance level is the new luminance level, and changing the luminance level of the screen of the electronic device includes identifying at least one of a new current amount and a new pulse width that is associated with the new luminance level.

9. The method of claim 8, wherein changing the luminance level of the screen of the electronic device further includes applying an optical correction to the new luminance level.

10. The method of claim 9, wherein the luminance level of the screen of the electronic device is changed based on at least one of a current amount and pulse width corresponding to the new luminance level.

11. The method of claim 1, wherein the difference between the first current amount and the second current amount is a minimum unit of adjustable current amount.

12. The method of claim 1, wherein the new luminance level is higher than the first luminance level and lower than the second luminance level.

13. An electronic device comprising:

a memory; and at least one processor operatively coupled to the memory, configured to:

obtain information of a first current amount and a first pulse width that correspond to a first luminance level, and information of a second current amount and a second pulse width that correspond a second luminance level;

detect at least one of a difference between the first current amount and the second current amount and a difference between the first pulse width and the second pulse width; and generate a new luminance level based on at least one of the difference between the first current amount and the second current amount or the difference between the first pulse width and the second pulse width, wherein when there is a difference between the first current amount and the second current amount and there is no difference between the first pulse width and the second pulse width, the new luminance level is generated by changing the first pulse width, wherein the at least one processor is configured to display a luminance adjustment menu, and wherein any of the first luminance level, the second luminance level, and the new luminance level is selectable from the luminance adjustment menu.

14. The electronic device of claim 13, wherein the at least one processor is further configured to:

detect a selection of a given luminance level from the luminance adjustment menu; and preview the given luminance level on a display module.

15. The electronic device of claim 14, wherein the at least one processor is further configured to:

detect an input that applies the given luminance level as a luminance of the display module; and change the luminance level of the display module to the given luminance level in response to the input.

16. The electronic device of claim 15, wherein the given luminance level is the new luminance level, and changing the luminance level of the display module includes obtaining information of at least one of a new current amount and a new pulse width that is associated with the new luminance level.

17. The electronic device of claim 16, wherein changing the luminance level of the display module further includes applying an optical correction to the new luminance level.

18. The electronic device of claim 17, wherein the luminance level of the display module is changed based on at least one of a current amount and pulse width corresponding to the new luminance level.

19. The electronic device of claim 13, wherein the new luminance level is higher than the first luminance level and lower than the second luminance level.

20. An electronic device comprising:

a display;

a memory arranged to store an indication of at least one of a first current amount that corresponds to a first luminance level, a first pulse width that correspond to the first luminance level, a second current amount that corresponds a second luminance level, and a second pulse width that corresponds to the second luminance level; and at least one processor operatively coupled to the memory, configured to:

obtain information of a third luminance level based on at least one of the first current amount, the first pulse width, the second current amount, and the second pulse width, wherein the third luminance level is between the first luminance level and the second luminance level; and operate the display at the third luminance level, wherein a third pulse width corresponding to the third luminance level is greater than the first pulse width and the second pulse width, wherein the at least one processor is configured to display, on the display, a luminance adjustment menu, and wherein any of the first luminance level, the second luminance level, and the third luminance level is selectable from the luminance adjustment menu.

21. A method for an electronic device comprising receiving a first event for decreasing luminance of a display of the electronic device from first degree to second degree in a first luminance range;

in response to the first event, adjusting a pulse and maintaining a current for decreasing luminance of the display in the first luminance range;

receiving a second event for decreasing luminance of the display of the electronic device from the second degree to third degree in the first luminance range; and in response to the second event, adjusting the pulse and maintaining the current for decreasing luminance of the display in the first luminance range, wherein the current is provided for a plurality of pixels of the display to emit light and the pulse is provided for designating an emitting duration of the plurality of pixels in a frame, and wherein the adjusting the pulse in response to the first event comprises narrowing a width of the pulse, and the adjusting the pulse and the current in response to the second event comprises widening a width of the pulse and decreasing an amount of the current.

22. The method of claim 21, wherein the first luminance range is a high luminance range, wherein the high luminance range is higher than a predetermined threshold luminance.

23. The method of claim 21, further comprising, in response to the first event, adjusting the pulse while maintaining the current for decreasing luminance of the display in a second luminance range, or in response to the second event, only adjusting one of the current or the pulse for decreasing luminance of the display in a second luminance range.

24. The method of claim 23, wherein the second luminance range is a low luminance range, wherein the low luminance range is lower than a predetermined threshold luminance.

25. The method of claim 23, wherein the adjusting the pulse while maintaining the current in the second luminance range comprises:

adjusting the width of the pulse and maintaining the amount of the current in the second luminance range.

26. An electronic device comprising:

a display;

a memory; and at least one processor operatively coupled to the memory and the display, configured to:

receive a first event for decreasing luminance of the display of the electronic device in a first luminance range;

in response to the first event, adjust a pulse and maintain a current for decreasing luminance of the display in the first luminance range;

receive a second event for decreasing luminance of the display of the electronic device in the first luminance range; and in response to the second event, adjust the pulse and the current for decreasing luminance of the display in the first luminance range, wherein the current is provided for a plurality of pixels of the display to emit light and the pulse is provided for designating a emitting duration of the plurality of pixels in a frame, and wherein the at least one processor is further configured to:

narrow a width of the pulse when the first event corresponds to an event for decreasing luminance of the display; and widen a width of the pulse and decrease the amount of the current when the second event corresponds to an event for decreasing luminance.

27. The electronic device of claim 26, wherein the first luminance range is a high luminance range, wherein the high luminance range is higher than a predetermined threshold luminance.

28. The electronic device of claim 26, wherein the at least one processor is further configured to:

adjust the pulse while maintaining the current for decreasing luminance of the display in a second luminance range; or only adjust one of the current or the pulse for decreasing luminance of the display in the second luminance range.

29. The electronic device of claim 28, wherein the second luminance range is a low luminance range, wherein the low luminance range is lower than a predetermined threshold luminance.

30. The electronic device of claim 28, wherein the at least one processor is further configured to:

adjust the width of the pulse and maintain the amount of the current in the second luminance range when the first event corresponds to the event for decreasing luminance.

31. An electronic device comprising:

a display;

at least one processor operatively connected to the display and configured to:

receive an event to change luminance of the display of the electronic device in a specific luminance range; and alternate between at least two of a plurality of pulse widths of a current signal to the display when incrementally increasing successive luminance values of the display in the specific luminance range.

32. The electronic device of claim 31, wherein the at least one processor is further configured to:

increase an amplitude of the current signal when incrementally increasing at alternating ones of the successive luminance values of the display in the specific luminance range.

* * * * *